United States Patent [19]

Czumak et al.

[11] 4,371,249

[45] Feb. 1, 1983

[54] FILM PROCESSING KIT

[75] Inventors: Frank M. Czumak, Salem, N.H.; Peter K. Fichter, Canton, Mass.

[73] Assignee: Polaroid Corporation, Cambridge, Mass.

[21] Appl. No.: 353,427

[22] Filed: Mar. 1, 1982

[51] Int. Cl.[3] ..... G03D 5/06

[52] U.S. Cl. ..... 354/304; 354/313; 354/318

[58] Field of Search ..... 354/83, 84, 85, 86, 354/87, 303, 304, 305, 312, 313, 314, 317, 318

[56] References Cited

U.S. PATENT DOCUMENTS

| | | | |
|---|---|---|---|
| 3,307,468 | 3/1967 | Briber | 354/318 |
| 3,483,809 | 12/1969 | Schmidt et al. | 354/87 |
| 3,667,361 | 6/1972 | Meggs et al. | 354/318 |
| 4,167,318 | 9/1979 | Wareham | 354/298 |
| 4,212,527 | 7/1980 | Fischer | 354/275 |
| 4,272,178 | 6/1981 | Bendoni et al. | 354/298 |
| 4,307,955 | 12/1981 | Cocco et al. | 354/303 |
| 4,309,100 | 1/1982 | Bendoni et al. | 354/303 |
| 4,313,667 | 2/1982 | Gold | 354/314 |
| 4,325,624 | 4/1982 | Pedroli | 354/304 |

OTHER PUBLICATIONS

Research Disclosure, pp. 53 and 54, Jan. 1981.

*Primary Examiner*—L. T. Hix
*Assistant Examiner*—Alan Mathews
*Attorney, Agent, or Firm*—Alfred E. Corrigan

[57] ABSTRACT

A disposable kit of the type adapted for use in a film processing apparatus in the processing of a roll of exposed instant type transparency film, preferably of the 35 mm format. The kit includes a two sectioned housing which encloses a roll of sheet material, a container of processing liquid, and a dispenser which is adapted to apply a coating of processing liquid to one side of the sheet material as it is being withdrawn from the housing prior to it being laminated to the exposed film. One of the housing sections is constructed such that a component of the processing apparatus may move it from a closed position to an open position wherein a rupturing mechanism of the processing apparatus may enter the housing and rupture the container of processing liquid. At the end of the processing cycle, the housing section is moved back into its closed position to thereby substantially enclose any residue of the processing operation.

6 Claims, 7 Drawing Figures

FILM PROCESSING KIT

RELATED APPLICATIONS

This application is related to application Ser. No. 353,426, entitled "Apparatus for Opening a Film Processing Kit", by Donald J. Sulesky and application Ser. No. 353,429, entitled "Film Processor", by William A. Holmes, both applications filed on even date herewith.

BACKGROUND OF THE INVENTION

1. Field of the Invention

This invention relates to a disposable kit for use in an apparatus for processing individual rolls of 35 mm instant type transparency film.

2. Description of the Prior Art

The present invention relates to a disposable kit of the type constructed to be placed within a film processor where its contents will be used in the processing of individual rolls of 35 mm instant type transparency film and, more particularly, to such a kit which is compact, inexpensive, easy to load and requires a minimum number of steps to be performed by the operator during such loading.

Lately, there has been several disclosures relative to the amateur photographer processing his own rolls of film. For example, U.S. Pat. Nos. 4,272,178, 4,212,527, and 4,167,318 disclose film assemblages of the type which include a film cassette containing a roll of 35 mm instant type transparency film, a length of sheet material and a container of processing liquid. After the film has been exposed in a conventional 35 mm still camera, it is placed in a film processor for subsequent processing. One questionable feature of this type of system is that the number of frames which a length of film may contain is limited by space taken up within the film cassette by the sheet material, it being remembered that the external measurements of the cassette must be kept within strict limits in order to insure its use in the various 35 mm cameras on the market. Other systems, such as those described in U.S. Pat. No. 4,309,100 and on pages 53 and 54 of RESEARCH DISCLOSURE, dated January 1981, show processors wherein the sheet material and processing liquid do not form components of the film assemblage. Accordingly, each element is individually mounted within the processing apparatus and operatively associated with the other elements so as to enable the processing of the film. However, this type of system allows the possibility that the operator may not properly connect or orient the different elements, e.g., installing the roll of sheet material such that its gelatin coated surface faces away from the processing liquid dispenser rather than toward it. Further, after the processing operation is over, one still has a problem of what to do with the processing residue, i.e., the remaining liquid and used sheet material, which in many cases is toxic and must be handled with care.

Lately, the art has progressed to the level whereat the roll of sheet material and the processing liquid have been incorporated into a disposable film processing kit, as evidenced by U.S. Pat. No. 4,307,955. While this type of disposable kit solves many of the problems discussed above, it still leaves room for improvement. For example, the molding of the processing liquid container as an integral part of the housing and the filling of the same with the liquid would appear to add to the cost of the kit. Further, if the processing liquid were, for some reason or another, out of spec, it would appear that the entire kit would have to be discarded, vis-a-vis a kit which could be readily opened and an individual processing liquid container located therein replaced.

SUMMARY OF THE INVENTION

The instant invention relates to a disposable kit which is specifically adapted for use within a film processing apparatus in the processing of an exposed roll of film, preferably of the 35 mm instant or self-developing transparency type. The kit includes a housing defined by first and second sections, a length of sheet material which is wound about a roller, a pod or rupturable container of processing liquid and a processing liquid dispenser. Normally, the two housing sections are latched in a closed position wherein they substantially fully enclose the other elements of the kit. The first section includes a channel into which a kit opening and closing member of the film processor is adapted to be inserted during loading of the kit into the film processor. The other elements are mounted within the second section. After the kit has been loaded into the processor and the two sections unlatched, the kit opening and closing member is actuated thereby moving the first section away from the second section thus exposing the container of processing liquid to a container rupturing mechanism. After the container is ruptured, its contents flow into the dispenser. The dispenser applies a coating of the liquid to a gel coated surface of the sheet material as the latter is being withdrawn from the housing. The sheet material is then married with the exposed film to form a laminate which is wound upon a take-up roller until visible images are formed in the laminate. The sheet material roller is then driven so as to rewind the sheet material fully into the housing while the film is simultaneously being stripped therefrom and rewound onto its spool. The kit opening and closing member then moves the first section into its closed position thereby fully enclosing the residue of the processing operation, i.e., any remaining processing liquid and the used sheet material. The processor may then be opened and the kit removed therefrom and safely discarded.

An object of the invention is to provide a disposable film processing kit which is adapted to be opened and closed by a member of a film processing apparatus.

Another object of the invention is to provide a disposable film processing kit which is adapted to be opened by a member of the processor prior to the start of a processing operation and which is closed by the member subsequent to the processing operation thereby enclosing the residue of the processing operation.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
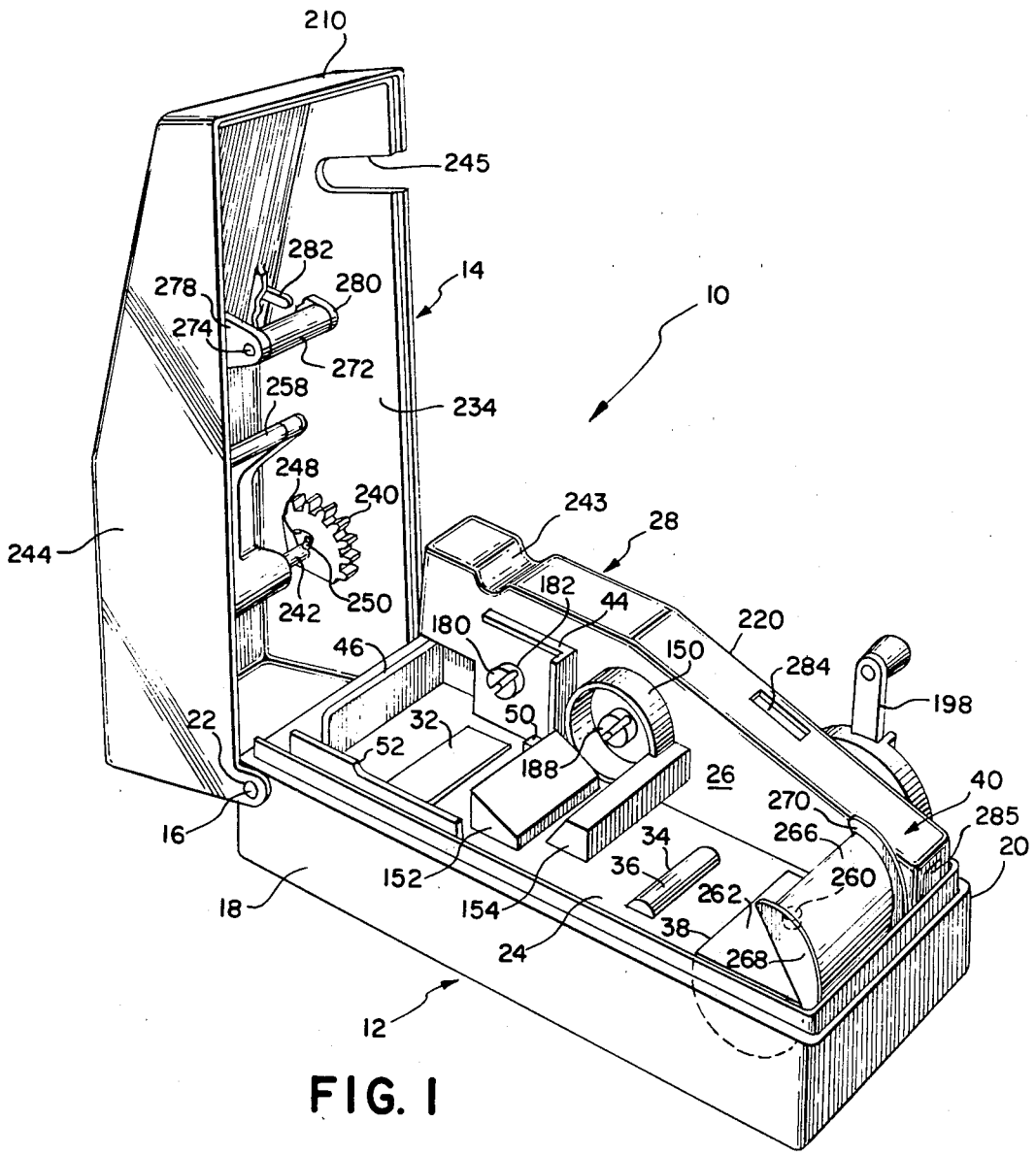
FIG. 1 is a perspective view of a preferred form of processor which is adapted for use with the disposable film processing kit of the instant invention in processing a length of exposed film.
Figure 2:
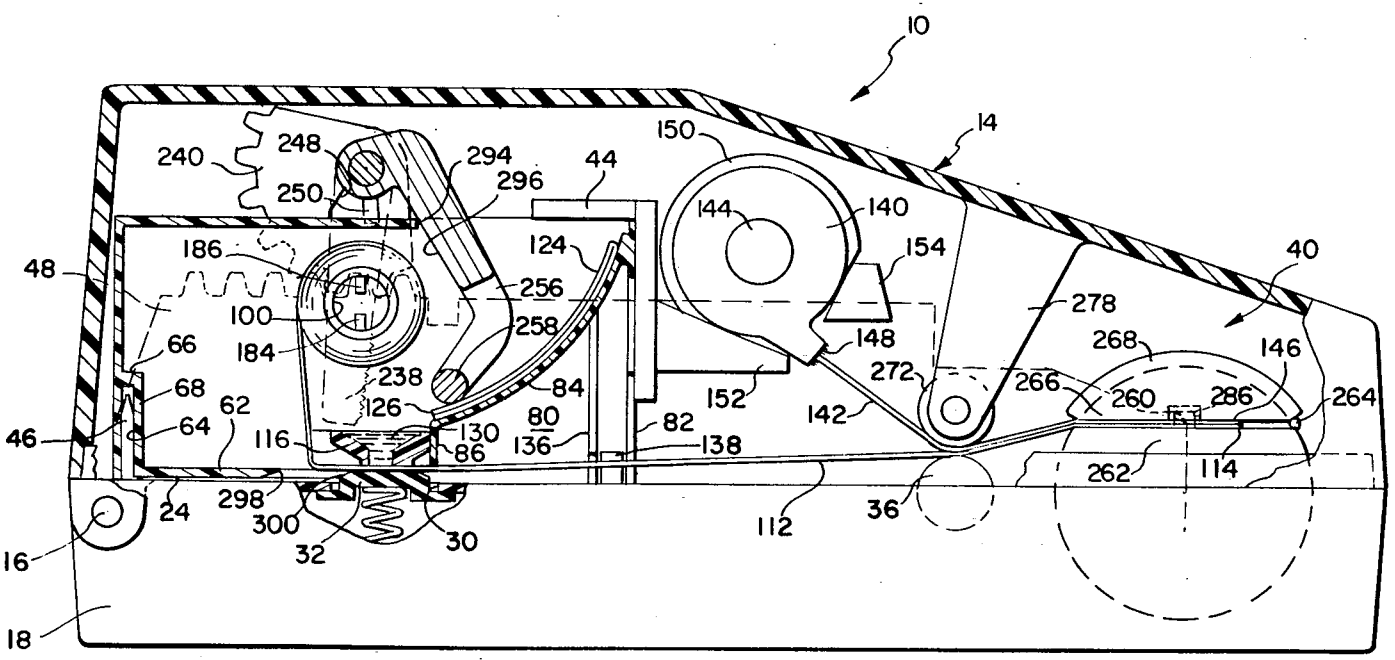
FIG. 2 is a side elevational view of the processor of FIG. 1, the processor being shown with its loading door in a closed position, certain parts being omitted or sectioned for reasons of clarity.

Reference is now made to the drawings and, in particular, to FIGS. 1 and 2 wherein is shown an apparatus 10 which is adapted for use with the kit of the instant invention in the processing of a roll of exposed film, the film preferably being of the 35 mm instant or self-developing type transparency film. The apparatus 10 includes a housing 12 having a loading door 14 pivotally coupled at one end thereof by a pair of pins 16 (only one being shown) which extend outwardly from opposite side walls 18 and 20 of the housing 12 and are received by apertures 22 (only one being shown) in the loading door 14. Movement of the loading door 14 into its closed position (see FIG. 2) renders the housing 12 lighttight.

A generally horizontal support 24 extends between the side wall 18 and a side wall 26 of a gearbox 28. The support includes a first opening 30 through which a spring-biased plate 32 is adapted to extend, a second opening 34 through which a portion of a roller 36 is adapted to extend, and a third opening 38 through which a portion of a take-up roller 40 is adapted to extend. Both the roller 36 and the take-up roller 40 are suitably mounted for rotation about their respective axes by means not shown.

The apparatus 10 also includes means for locating a film processing kit 42 in its proper position relative to other elements of the apparatus 10. Generally, these means include an L-shaped flange 44 which extends inwardly from the side wall 26 of the gearbox 28, an arm 46 which extends at a right angle to a rack 48 (see FIG. 4), a pair of cams 50 (only one being shown) which are located adjacent opposite sides of the horizontal support 24, and a plate 52 which extends along the side wall 18.

Figure 6A:
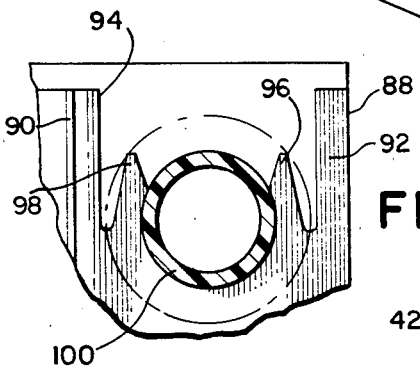
FIG. 6*a* is a side elevational view of a portion of the film processing kit.
Figure 6:
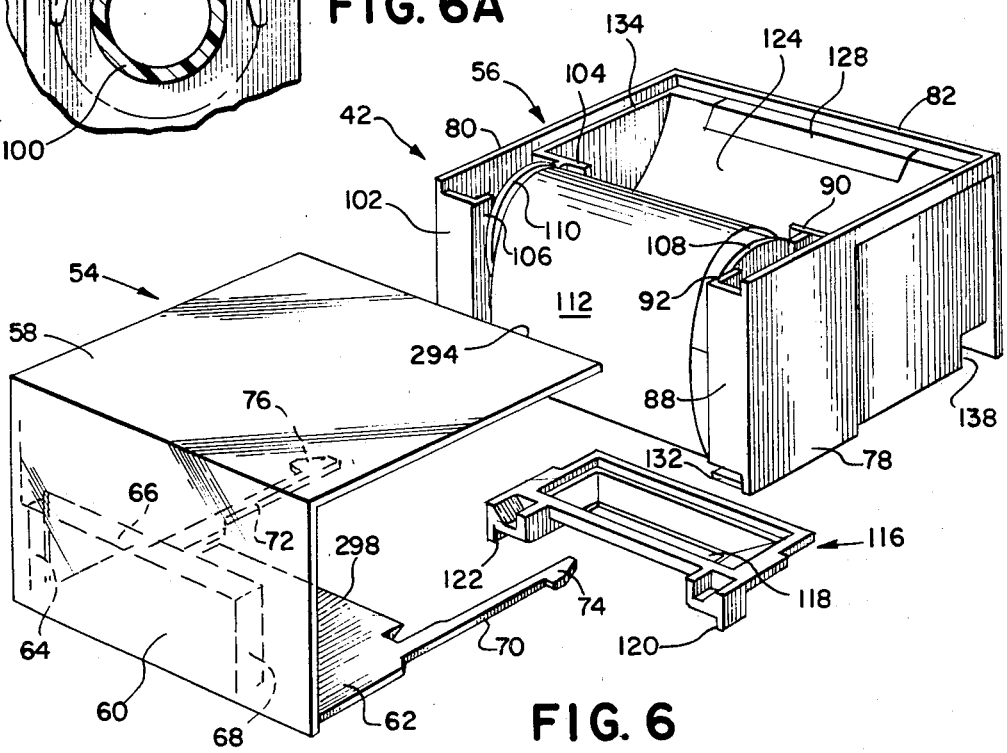
FIG. 6 is a partly exploded perspective view of a disposable film processing kit which is a preferred embodiment of the instant invention and which is especially adapted for use with the processor shown in FIG. 1.

The film processing kit, as best shown in FIG. 6, includes a housing consisting of a first section 54 and a second section 56 which is constructed to telescopically receive the first section 54. The first section includes a top wall 58, an end wall 60, and a bottom wall 62. The end wall 60, as best seen in FIG. 2, includes a passageway 64 formed by a generally horizontal flange 66 and a vertical flange 68 for receiving the arm 46 of the link 48. The bottom wall 62, which has a length slightly less than one-half that of the top wall 58, includes a laterally spaced pair of fingers 70 and 72 whose ends are provided with tapered latching members 74 and 76, respectively.

The second section 56 includes a pair of side walls 78 and 80 interconnected at one end by an end wall 82. A gently curving wall 84 extends between the side walls 78 and 80 and slopes downwardly from the top of the end wall 82 to a point where it terminates in a generally vertical wall 86. A pair of flanges 88 and 90 extend inwardly from the side wall 78 to a point where they are interconnected by a wall 92 (see FIG. 6*a*). The wall 92 has a U-shaped opening 94 therein. A pair of resilient fingers 96 and 98, which are integral with the wall 92, extend into the U-shaped opening. As best seen in FIG. 6*a*, the resilient fingers 96 and 98 are adapted to be moved away from each other as the end of a roller 100 is moved downwardly into the U-shaped opening 94 to thereby provide a drag on the end of the roller 100. A pair of flanges 102 and 104 extend inwardly from the side wall 80 to a point where they are interconnected by a wall 106 having a U-shaped opening (not shown) therein for rotatably receiving the opposite end of the roller 100. The roller 100 has a pair of annular flanges 108 and 110 which are adapted to be positioned between the walls 92 and 106. A length of sheet material 112, e.g., a polyester film such as Mylar having a gelatin coating on one side, is coiled about the roller 100 with a trailing end secured to the roller 100 and a leading end 114 which is adapted to be releasably attached to an exterior surface of the end wall 82. An opening (not shown) is located in wall 80 in alignment with the end of the roller 100 so as to enable a drive member to protrude therethrough and drivingly engage the roller 100, as will be further explained later.

Also mounted in the second section 56 is a processing liquid dispenser 116. The dispenser includes a nozzle 118 and a pair of laterally spaced flanges 120 and 122 which function to restrain sidewise movement of the sheet material 112 as it passes beneath the nozzle 118. The nozzle has a length which is less than the width of the sheet material 112 and is approximately equal to the distance between laterally spaced sprocket holes in a strip of 35 mm film, i.e., two and one-half centimeters.

A container 124 having a rupturable end 126 is supported on the wall 84 by any suitable means, e.g., by a strip of adhesive tape 128. The container 124 holds a supply of viscous processing liquid 130, the quantity of which is sufficient to coat substantially the entire length of the sheet material 112.

A flange 132 extends inwardly from the bottom of the side wall 78. The flange 132 cooperates with a similar flange (not shown) which extends inwardly from the side wall 80 to guide the lateral edges of the bottom wall 62 as the second section 56 telescopically receives the first section 54 during closing of the kit 42. A recessed area 134 extends around portions of the side walls 78 and 80 and the end wall 82 and cooperates with the tops of the flanges 88, 90, 102 and 104 to receive the edges of the top wall 58. As the edge of the top wall 58 moves into engagement with the end wall 82, the latching members 74 and 76 are first cammed inwardly toward each other by a pair of flanges 136 (only one being shown) which extend inwardly from the side walls 78 and 80. The members 74 and 76 then spring outwardly to grab the right side, as viewed in FIG. 2, of the flanges 136 thereby locking the two sections 54 and 56 in the closed position, with the bottom wall 62 holding the sheet material 112 in sealing relation to the nozzle 118. The latching members 74 and 76 are adapted to be moved out of latching engagement with the flanges 136 by the cams 50 in the apparatus 10 as the kit is being loaded in the apparatus. During such loading, the cams 50 enter a pair of apertures 138 (only one being shown) located in the side walls 78 and 80 and force the latching members 74 and 76 inwardly toward each.

The apparatus 10 further includes means for supporting a film cassette 140 containing a roll of exposed, self-developing type transparency film 142, the film being wound upon a rotatable film spool 144 with one end of the film being secured to the film spool 144 and its opposite end 146 being adapted to extend to the exterior of the film cassette via a film withdrawal slot 148. These means include a semi-annular flange 150, which is adapted to receive one end of the generally cylindrical film cassette 140, and a pair of supports 152 and 154.

Figure 5:
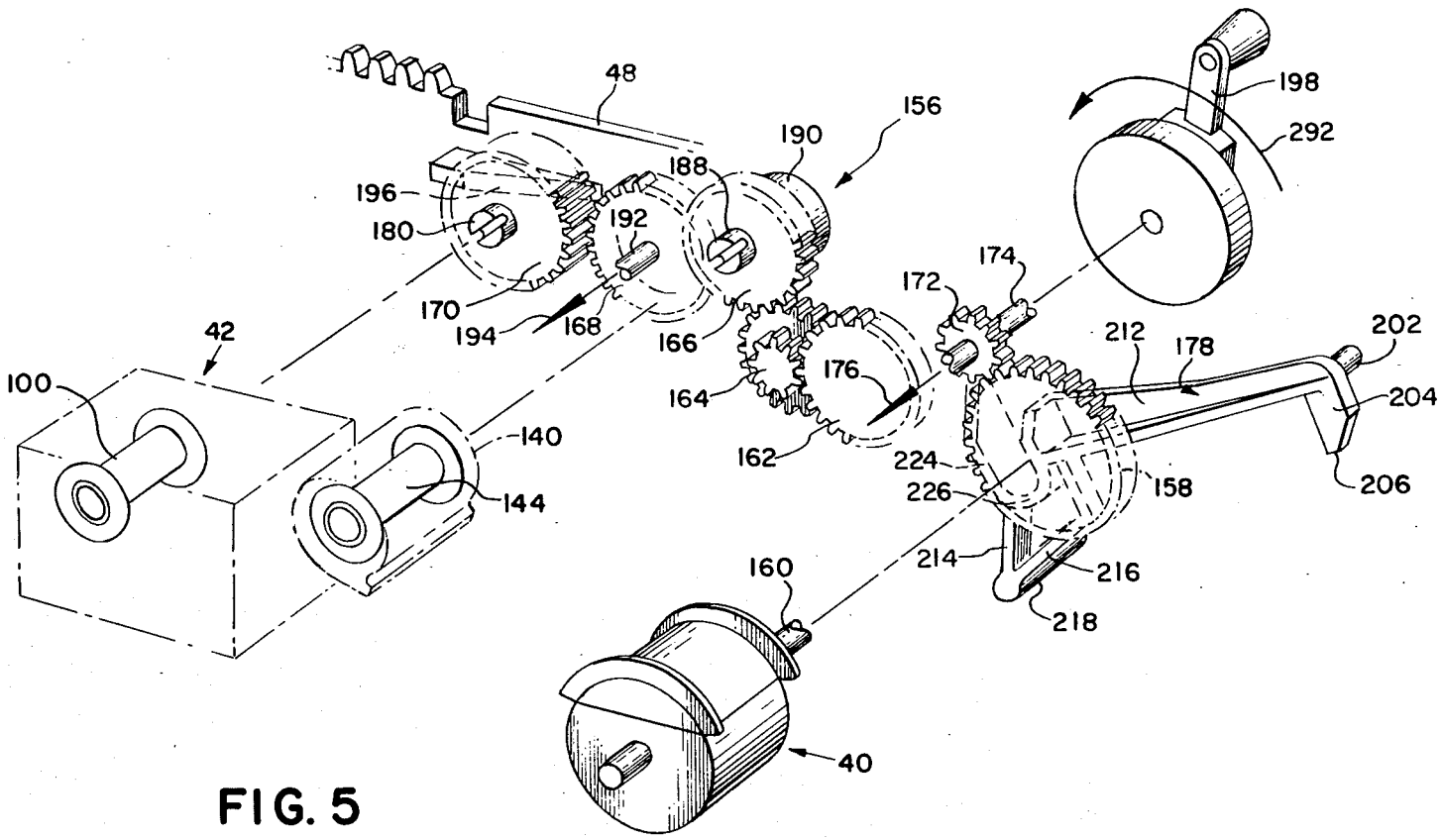
FIG. 5 is a schematic representation of the processor's power transmission system and its relation to various other elements which are part of or usable with the instant invention.

A power transmission means 156 is mounted within the gearbox 28. As shown in FIG. 5, the power transmission means 156 includes a first power path consisting of a gear 158 which is fixedly attached to a shaft 160 which, in turn, is fixedly attached to the take-up roller 40, a second power path consisting of gears 162, 164 (compound), 166, 168 and 170, and an element, i.e., a gear 172. The gear 172 is mounted on a shaft 174 for limited axial movement between a first position wherein it is solely in drivable engagement with the second power path and a second position (shown in FIG. 5) wherein it is solely in drivable engagement with the first power path. The gear 172 is normally biased into engagement with the gear 158 and is adapted to be moved in the direction of the arrow 176 into engagement with the gear 162 by a bell crank 178, as will be further explained shortly. A slotted drive member 180 extends from the face of the gear 170 and protrudes through an opening 182 in the wall 26 of the gearbox 28 where it is adapted to drivingly engage a pair of tabs 184 and 186 (see FIG. 2) which are integrally formed with the roller 100. A similar drive member 188 extends from the face of the gear 166 and protrudes through an aperture in the side wall 26 where it is adapted to be located in driving engagement with the end of the film spool 144. A clutch 190 is coupled between the gear 166 and its drive member 188 to allow slippage therebetween during the time that the roller 100 and film spool 144 are being driven, thereby compensating for any differences in the increasing diameters of the roll of sheet material 112 and the film 142. It will also be noted that the gear 168 is mounted for limited linear movement along its shaft 192. The gear is normally biased out of engagement with the gear 166 when the take-up roller 40 is being driven and is adapted to be moved in the direction of the arrow 194 into driving engagement with the gear 166 by a cam 196 located on the side of the rack 48, as will be more fully explained hereinafter. The power input to the power transmission means 156 includes a manually operable hand crank 198 which is fixedly attached to the shaft 174 at a point where the shaft 174 protrudes through the side wall 20 of the apparatus 10.

Figure 3:
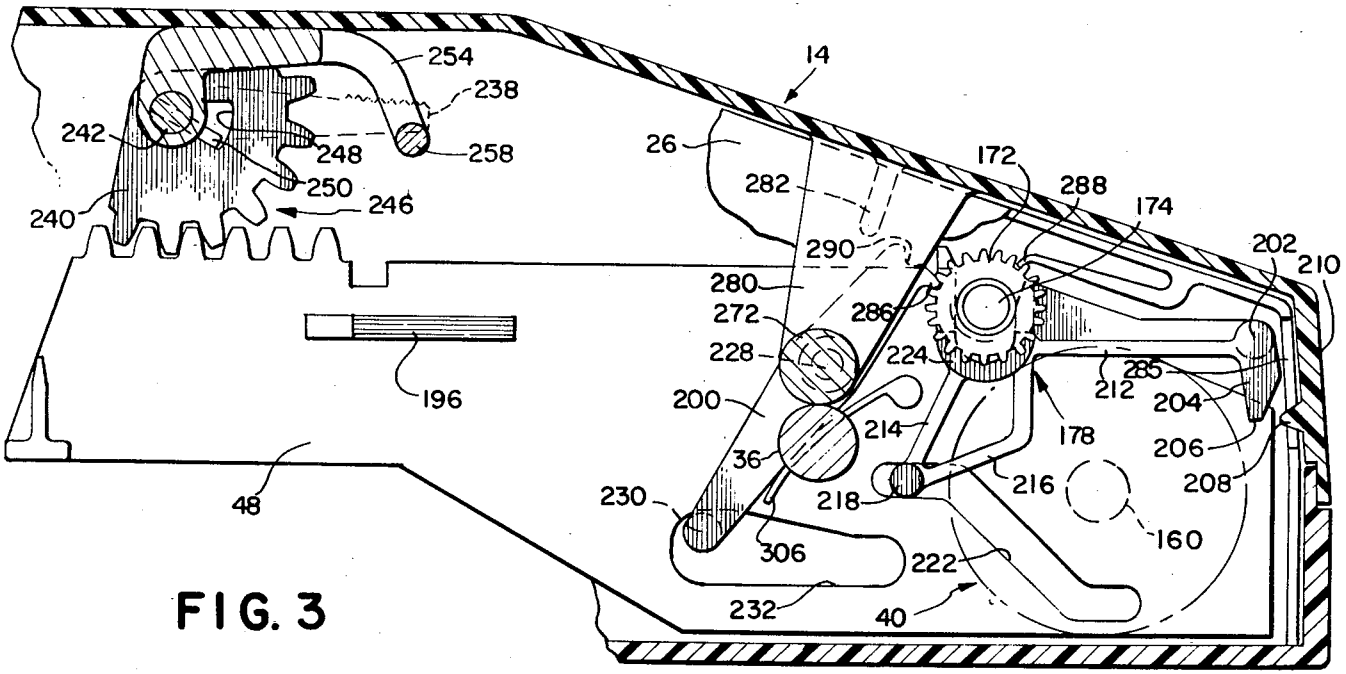
FIG. 3 is an enlarged side elevational view, partly in section, of a portion of the processor of FIG. 1.
Figure 4:
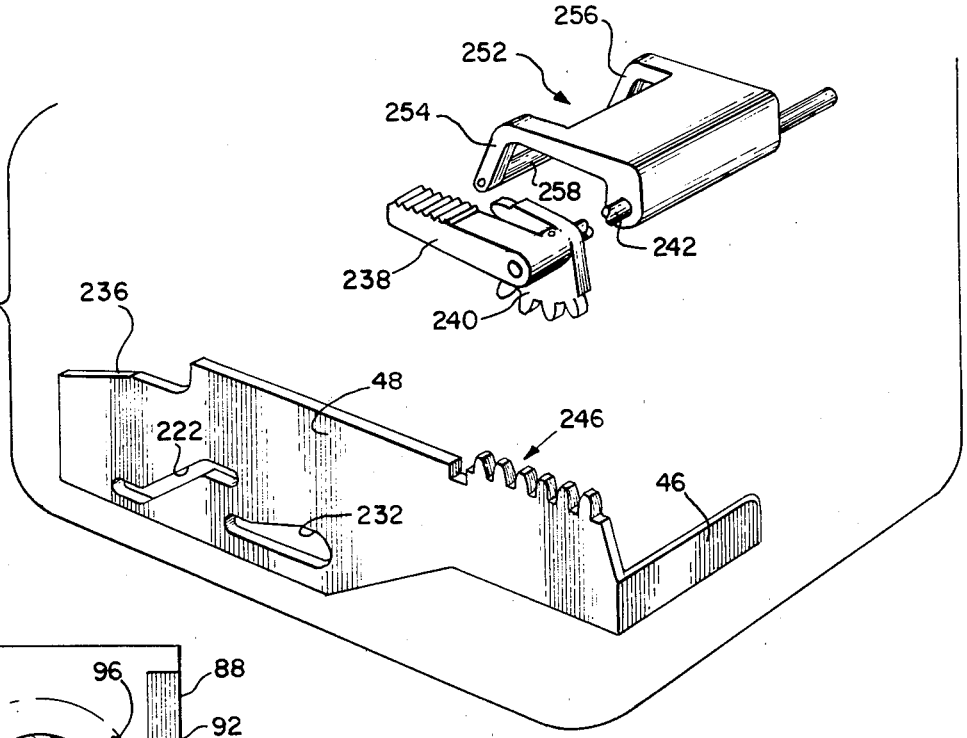
FIG. 4 is an exploded perspective view of a lost motion system.

Reference is now made to FIG. 3 wherein the operation of the bell crank 178 will be more fully described. In this view, the take-up roller 40 is shown in phantom lines so as to facilitate an understanding of the movement of the bell crank 178. Further, although the bell crank 178 and a juxtaposed link 200 are located within the gearbox 28, the power transmission system 156, except for gear 172, has been omitted for reasons of clarity. The bell crank 178 and the link 200 are adapted to interrelate with the rack 48 to provide a plurality of functions. Specifically, the bell crank 178 is pivotally coupled to a wall of the gearbox 28 by a pin 202 which extends outwardly from the bell crank 178. One arm 204 of the bell crank 178 includes a latching surface 206 which is adapted to be moved into engagement with a lip 208 formed on the interior surface of an end wall 210 of the loading door 14 so as to lock it in the closed position. The other arm 212 of the bell crank 178 includes a pair of downwardly converging legs 214 and 216 which are joined at their end by a cam follower 218 which extends at right angles to a plane containing the legs 214 and 216. The cam follower 218 extends through an arcuate slot (not shown) in a side wall 220 to a point where its end terminates in a cam slot 222 in the rack 48. The upper left hand end of the arm 212 includes a U-shaped portion 224 having inclined camming surfaces 226. The U-shaped portion 224 is constructed to move the gear 172, against its spring bias, from engagement with the gear 158 and into engagement with the gear 162 when the bell crank 178 is rotated in a clockwise direction about its pivot pin 202. The link 200 is pivotally connected intermediate its ends by a pin 228 which extends between the side walls 26 and 220 of the gearbox 28. One end of the link 200 includes a cam follower 230 which extends at right angles thereto. The cam follower 230 protrudes through another arcuate slot (not shown) in the side wall 220 and terminates at a location within a second cam slot 232 in the rack 48. The rack 48 is supported by means (not shown) between the side wall 220 and a side wall 234 of the loading door 14. As best seen in FIG. 4, one end of the rack 48 is cut away at 236 to provide clearance for the shaft 74 of the crank 198 when the rack is reciprocated into the position shown in FIG. 3.

The rack 48 is adapted to be reciprocated from a first position, as shown in FIG. 3, to a second position, as shown in FIGS. 2 and 5. The mechanism for reciprocating the rack 48 includes a manually operable lever 238 which is fixedly coupled to a sector gear 240, and the two are freely rotatable on a shaft 242 which has its opposite ends journaled in the side walls 234 and 244 of the loading door 14. The teeth of the sector gear 240 are adapted to drivingly engage a set of teeth 246 located in the top edge of the rack 48 when the loading door 14 is in the closed position. The sector gear 240 includes an aperture 248 which is adapted to receive a pin 250 which extends radially outwardly from the shaft 242 to define a lost motion connection between the lever 238 and a processing fluid container rupturing mechanism 252. The mechanism 252, which is integrally formed with the shaft 242, includes a pair of arms 254 and 256 which rotatably support a roller 258 therebetween.

In the operation of the apparatus 10, a closed kit 42 is positioned within the apparatus 10 such that the drive member 180 engages the drive flanges 184 and 186 of the sheet material roller 100, the arm 46 of the rack extends into the passageway 64 and the cams 50 enter the apertures 138 in the side walls 78 and 80 of the second section 56 of the kit 42 thereby moving the latching members 74 and 76 into an inoperative position. Also, the leading end 114 of the sheet material is detached from the end wall 82 of the kit 42 and trailed across the roller 36 and finally attached to a pin 260 which extends upwardly from a section 262 of the take-up roller 40. As best shown in FIG. 1, the section 262 is pivotally connected by a hinge 264 to a second section 266 of the take-up roller 40. The second section 266 includes flanges 268 and 270 at opposite ends thereof for guiding the sheet material 112 and the film 142 onto the take-up spool 40 during clockwise rotation of the latter. Next, the film cassette 140 containing the exposed roll of film 142 is loaded into the apparatus 10 such that the drive member 188 drivingly engages the end of the film spool 144 and the members 152 and 154 support the film cassette 140, as shown in FIG. 2. The leading end 146 of the film 142 is then attached to the pin 260 such that the emulsion side of the film 142 faces the gel coated surface of the sheet material 112. The leading ends 114 and 146 of the sheet material 112 and the film 142, respectively, are each provided with an aperture (not shown) for such attachment to the pin 260. The second section 266 is then pivoted into superposition with the first section 262 such that an aperture 286 therein receives the pin 260. The loading door is then closed thereby bringing a roller 272 into superposition with the roller 36. The journals 274 of the roller 272 are suitably supported in the ends of a pair of supporting arms 278 and 280 which extend downwardly from the loading door 14. The closing of the loading door 14 also moves (1) the teeth of the sector gear 240 into mesh with the gear teeth 246, and (2) a latch pin 282, which extends downwardly from the loading door 14, into the gearbox 28 via an opening 284 therein. With the loading door 14 closed, thereby rendering the apparatus lighttight, the elements shown in FIG. 3 are positioned as shown. The gearbox 28 is recessed at 243 to accommodate the shaft 242, and the door 14 is cut away at 245 to provide clearance for the shaft of the crank 198 when the door 14 is in the closed position.

Processing of the film 142 is initiated by the operator turning the lever 238 from a non-processing position shown in FIG. 3 to a processing position shown in FIG. 2. Initial rotation of the lever 238 into the processing position is immediately transferred to the rack 48 via the teeth of the sector gear 240 thereby moving the rack 48 rearwardly, i.e., to the left as viewed in FIGS. 2 and 3. This movement of the rack 48 causes several events to occur. Specifically, as the rack 48 moves to the left, the cam slots 222 and 232 therein cause the bell crank 178 and the link 200 to rotate in a counterclockwise direction about their respective pivots 202 and 228, respectively. Such rotation of the bell crank 178 results in its U-shaped portion 224 moving downwardly out of engagement with the gear 172 thereby enabling it to return, under its spring bias, to its normal position in engagement with the gear 158, as shown in FIG. 5. Simultaneously therewith, the latching surface 206 of the end 204 of the bell crank 178 has rotated through an opening 285 in the gearbox 28 into latching relation to the lip 208 thereby precluding accidental opening of the loading door 14 at this time in the processing cycle. The rotation of the link 200 functions to remove a pawl 286, which is an integral part of the link 200, from engagement with the teeth of the gear 172 thereby permitting subsequent counterclockwise rotation thereof. The pawl 286 of the link 200 is held out of engagement with the gear 172 by the latch pin 282 which enters a recess 290 in the top of the link 200. The latch pin 282 will continue to maintain the pawl 286 out of engagement with the gear 172 until the latching door 14 is opened. Clockwise rotation of the gear 172 is prevented by a second pawl 288 which extends downwardly from the top wall of the gearbox 28 into engagement with the teeth of the gear 172. The rearward movement of the rack 48 also moves the cam 196 in a direction which enables the gear 168 to move, under its spring bias, along the shaft 192 to a position wherein it is no longer in engagement with the gear 166. Further, rearward movement of the rack 48 is effective to cause its arm 46 to move the first section 54 of the kit 42 away from the second section 56 (the second section 56 being maintained in position by the cams 50) thereby opening the kit prior to the rupturing mechanism 252 being rotated toward the container 124.

After the lever 238 has been rotated through an angle of approximately twenty-three degrees, the right side (as viewed in FIG. 2) of the aperture 248 in the sector gear 240 moves into engagement with the pin 250 thereby causing any continued rotation of the lever 238 toward the processing position to not only continue the rearward movement of the rack 48 but also to commence the rotation of the rupturing mechanism 252 toward the position shown in FIG. 2. Because of the aforedescribed lost motion connection between the lever 238 and the pin 250, the roller 258 moves into the kit 42 as its top wall 58 moves out of interference therewith. The roller 258 engages the container 124 and increases the pressure on the processing liquid 130 therein to a point where the end 126 of the container ruptures. Continued clockwise rotation of the roller 258 about its pivot pin 242 causes the roller 258 to force the processing liquid from the container 124 into the dispenser 116.

Once the lever 238 is in the processing position, as shown in FIG. 2, the operator rotates the crank 198 in the direction of the arrow 292 thereby providing a power input to the first power path, i.e., the gear 158, to rotate the take-up roller 40 in a clockwise direction, as viewed in FIG. 2. Such rotation of the take-up roller 40 is effective to withdraw the sheet material 112 from its roller 100, move it past the nozzle 118 of the dispenser 116, whereat it is resiliently urged into engagement with the nozzle 118 by the plate 32 such that a uniform coating of the processing liquid 130 may be applied thereto, and then toward the bite of the rollers 36 and 272 where it will be married with the film 142 (which is also being withdrawn from its cassette 140). The rollers 36 and 272 press the gel coated surface of the sheet material 112 into engagement with the emulsion side of the exposed film 142 so as to form a laminate comprised of a layer of processing liquid 130 sandwiched between the sheet material 112 and the exposed film 142. The resulting laminate is then wound upon the take-up roller 40. When the sheet material 112 and/or the film 142 have been completely uncoiled from their respective supports, but not detached therefrom, the resultant increase in tension in the laminate is automatically fed back to the crank 198 thereby signaling the operator to stop rotating the crank 198. To prevent any damage to the apparatus 10 or the laminate, a clutch 294 may be coupled between the shaft 174 and the crank 198 so that further rotation of the crank 198 by the operator is not transferred to the shaft 174. The laminate is then allowed to remain upon the take-up roller 40 for a period of time, e.g., one minute, which is sufficient for visible images to be formed in the laminate, preferably in the film 142.

After the processing of the visible images within the laminate has been substantially completed, the lever 238 is rotated in a counterclockwise direction, as viewed in FIG. 2, toward the non-processing or post processing position. Such rotation is effective to immediately drive the rack 48 forwardly toward the take-up roller 40 while simultaneously moving the first section 54 of the kit 42 into closing relation with the second section 56. Although initial rotation of the lever 238 is not transferred to the rupturing mechanism 252 because of the aforedescribed lost motion connection, the mechanism 252 is given a head start due to an edge 294 of the top wall 58 of the first section 54 engaging the undersurface 296 of the mechanism and pivoting it upwardly until such time that the left side of the aperture 248 engages the pin 250 so as to complete the movement of the rupturing mechanism 252 out of the kit 42 before it closes. Further, it should be noted that an edge 298 of the bottom wall 62 of the first section 54 is beveled such that it may cooperate with a radius 300 on the spring biased plate 32 so as to urge the plate 32 downwardly thereby enabling the edge 298 to pass to a point where the bottom wall 62 seals the nozzle 118. Movement of the rack 48 from its rearward or processing position, as shown in FIG. 2, to its forward or post processing position, as shown in FIG. 3, also effects a clockwise rotation of the bell crank 178 due to the cam slot 222 and cam follower 218 relationship. This rotation pivots the end 206 of the arm 204 out of latching relation with the lip 208. It also results in the U-shaped section 224 moving upwardly into contact with the gear 172 such that its cam surface 226 will move the gear 172 out of engagement with the gear 158 and into engagement with the gear 162. Further, the cam 196 on the rack moves the gear 168 back into engagement with the gear 166. However, the movement of the rack 48 into the post processing position does not affect the position of the link 200 since the pin 290 maintains it in a position wherein the pawl 286 is held, against the bias of the free end 306 of a spring, out of engagement with the teeth of the gear 172.

With the lever 238 in the horizontal or post processing position, the operator may then rotate the crank 198 in the same direction as before, i.e., in the direction of the arrow 292. This power input is directed to the second power path via the gear 172 thereby rotating the sheet material roller 100 and the film spool 144 in a clockwise manner, as viewed in FIG. 5. The clockwise rotation of the roller 100 and the film spool 144 is effective to withdraw or unwind the laminate from the take-up roller 40. As the laminate emerges from the left side (as viewed in FIG. 2) of the superposed rollers 36 and 272, the film 142 is stripped from the sheet material 112 and rewound upon the film spool 144 as the sheet material 112 is simultaneously rewound upon its roller 100. As is more fully described in the '100 patent cited above, in a preferred type of film, the photosensitive or emulsion layer of the film 142 exhibits a greater adhesion to the sheet material 112 than to the next adjacent layer(s) of the film whereby stripping the sheet material 112 from the film 142 serves to remove the emulsion layer thus increasing visual acuity and brightness of the resultant positive transparency and enhancing its stability by virtue of the removal of residual processing reagent in the emulsion. For further details of the film, reference may be had to U.S. Pat. No. 3,682,637.

In an alternative embodiment, the visible images would be formed in the sheet material. Accordingly, the film would be comprised of a photosensitive layer through which the exposure would be made, vis-a-vis the film 142, and a base which may or may not be transparent. Also, the sheet material would be comprised of a transparent base and an image receiving layer. Subsequent to the exposure of the film, the side of the sheet material containing the image receiving layer would be coated with the processing liquid and brought into engagement or superposition with the side of the film through which the exposure had been made. This may involve reversing the orientation of the film cassette from the position shown in FIG. 2 so as to place the image receiving layer in contact with the emulsion side of the film. After the spreader sheet had been rewound upon its spool, the spool would be removed and the individual scenes in the sheet material would be cut and mounted for subsequent viewing.

Withdrawing the laminate from the take-up roller 40 causes the latter to rotate in a counterclockwise direction, as viewed in FIG. 2. As the last wrap of the laminate is removed from the take-up roller 40, the portion of the laminate extending between the bite of the rollers 36 and 272 and the free end of the second section 266 of the take-up roller 40 assumes an angle which ultimately pivots the second section 266 about the hinge 264 thereby automatically allowing the ends 114 and 146 of the sheet material 112 and the film 142, respectively, to free themselves from attachment to the take-up roller 40. Rotation of the crank 198 is continued for a few turns after the operator feels the release of the end of the laminate from the take-up roller 40 so as to completely rewind the end 114 of the sheet material 112 into the kit 42. The loading door 14 may then be opened thereby releasing the link 200 for movement back into the position shown in FIG. 3. The kit 42 may now be removed and safely discarded since all materials used in the processing of the film 142 are safely enclosed within the closed kit. Also, at this time the film cassette 140 may be removed from the apparatus and the processed film removed therefrom for subsequent cutting and mounting of the individual scenes.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. A disposable kit configured to be placed within a film processing apparatus wherein it is adapted for use in the processing of a photographically exposed roll of instant type transparency film, said kit comprising:

a housing including first and second sections coupled to each other for movement between open and closed positions;

a container of processing liquid supported within said second section, said container having a rupturable section;

a processing liquid dispenser located adjacent said rupturable section of said container, said dispenser including a nozzle through which the processing liquid is adapted to flow;

a roller rotatably supported within said housing;

a strip of sheet material wound upon said roller with a first end secured to said roller and a second end which extends to a position in engagement with said nozzle and thence to the exterior of said housing, said sheet material being adapted to be partially withdrawn from said housing and superposed with the exposed film to form a laminate having a coating of processing liquid therebetween; and said first section further includes means cooperable with a component of the film processing apparatus for moving said first section from said closed position to said open position wherein a rupturing mechanism of the film processing apparatus may enter said housing and rupture said container whereby said processing liquid may then flow into said dispenser for subsequent application to said sheet material via said nozzle as said sheet material is being withdrawn from said housing.

2. A disposable kit as defined in claim 1 wherein said first section further includes latching means cooperable with said second section for releasably latching said first and second sections in said closed position.

3. A disposable kit as defined in claim 2 wherein said latching means is constructed to be automatically moved into an unlatched position in response to being loaded into the film processing apparatus.

4. A disposable kit as defined in claim 1 wherein said roller includes means adapted to be driven by a component of the film processing apparatus in a direction so as to completely withdraw said second end of said sheet material into said housing subsequent to its use in processing the exposed film.

5. A disposable kit as defined in claim 4 wherein said first and second sections of said housing, when in said closed position, substantially enclose any processing liquid residue thereby permitting the safe disposal of the kit subsequent to its use in the film processing apparatus.

6. A disposable processing kit as defined in claim 1 wherein said first section includes means engageable with the rupturing mechanism for moving it toward the exterior of said housing as said first section is being moved from said open position to said closed position.

* * * * *